US005164775A

United States Patent [19]

Miller et al.

[11] Patent Number: 5,164,775

[45] Date of Patent: Nov. 17, 1992

[54] TONER MONITOR SYSTEM FOR DEVELOPMENT MIXTURE CONTROL IN ELECTROSTATOGRAPHIC APPARATUS

[75] Inventors: Gregory L. Miller, Holley; Matthias H. Regelsberger, Rochester, both of N.Y.

[73] Assignee: Eastman Kodak Company, Rochester, N.Y.

[21] Appl. No.: 770,266

[22] Filed: Oct. 3, 1991

[51] Int. Cl.[5] ..... G03G 21/00

[52] U.S. Cl. ..... 355/246; 118/689; 355/208

[58] Field of Search ..... 355/208, 204, 246; 118/689, 690, 691

[56] References Cited

U.S. PATENT DOCUMENTS

| | | | |
|---|---|---|---|
| 4,054,230 | 10/1977 | Suzuki et al. | 222/1 |
| 4,592,645 | 6/1986 | Kanai et al. | 355/246 X |
| 4,742,370 | 5/1988 | Murakami et al. | 355/246 |
| 4,801,980 | 1/1989 | Arai et al. | 355/246 X |
| 4,901,115 | 2/1990 | Nakamura et al. | 355/246 |
| 4,916,488 | 4/1990 | Kimura | 355/246 X |
| 4,931,835 | 6/1990 | Higgins et al. | 355/246 |
| 4,955,317 | 9/1990 | Kinoshita et al. | 355/246 X |

FOREIGN PATENT DOCUMENTS

| | | |
|---|---|---|
| 0313179 | 12/1988 | Japan . |
| 0033170 | 2/1990 | Japan . |

*Primary Examiner*—A. T. Grimley
*Assistant Examiner*—Robert Beatty
*Attorney, Agent, or Firm*—David A. Howley

[57] ABSTRACT

A toner monitor system includes a toner monitor having an output signal which is proportional to the toner concentration of a measured development mixture and further to an applied control voltage. The control voltage is set such that the toner monitor output voltage midpoint is constant regardless of environmental changes. The output voltage is centered at mid range for a nominal toner concentration, and the control voltage setting used to center the toner monitor output voltage at its midpoint is stored during a setup cycle. A reference member having a temperature stable magnetic permeability is positioned to align with the toner monitor so as to simulate to the toner monitor a nominal toner concentration, wherein the control voltage setting centers the toner monitor output voltage at its midpoint for the nominal toner concentration.

10 Claims, 2 Drawing Sheets

TONER MONITOR SYSTEM FOR DEVELOPMENT MIXTURE CONTROL IN ELECTROSTATOGRAPHIC APPARATUS

CROSS REFERENCE TO RELATED APPLICATION

This application is related to commonly assigned U.S. patent application Ser. No. 07/632,677, filed in the names of A. S. Kroll and W. Chang on Dec. 24, 1990.

BACKGROUND OF THE INVENTION

1. Technical Field

This invention relates generally to toner concentration control systems used in electrostatographic marking engines.

2. Background Art

With the development of electrostatographic marking engines using more than one color, the need arises to monitor and control the toner concentration in more than one development mixture. Since manufacturing costs have to be minimized, much engineering effort focuses on developing cost effective solutions at uncompromised performance. To this end, it has been proposed that cost effective control of toner concentrations in more than one developmemt mixture can be accomplished by using only one toner monitor. See for example commonly assigned U.S. patent application Ser. No. 07/632,677, filed in the names of A. S. Kroll and W. Chang on Dec. 24, 1990.

In order to obtain a statistically significant toner monitor reading, particularly in conjunction with the hard magnetic materials used in some development mixtures, one must tightly control environmental effects, the mechanical interface between the development mixture and the toner monitor, and/or the variation in electrical performance of the toner monitor. Since environmental conditions are largely unpredictable, a rather large range in operating temperature (i.e., 10° C. to 35° C.) has to be considered in the design to make the product attractive for general consumer application. Even such a limited operating temperature range may often cause a shift in toner monitor readings $V_M$ equal to a change of several percent toner concentration in the development mixture. Therefore, the statistical significance of the monitor reading $V_M$ over the full range of operating temperature, is questionable.

Kroll and Chang proposed the use of an environmentally stable reference member which, when presented to the toner monitor, simulates the magnetic permeability of the actual development mixture. The resultant temperature stable reference reading is used to correct the toner concentration readings obtained from the development mixture under any operating environment.

Since many different toner monitors will be used, variations between toner monitors will make the development of one algorithm suited to correct the temperature effects of all toner monitors over the lifetime of the program very difficult, if not impossible. Because it is not economical to characterize every single toner monitor in a manufacturing environment in order to match the algorithm applying the temperature correction, assumptions regarding the monitor's performance and performance compromises will have to be made; making the statistical significance of the toner monitor reading again questionable.

DISCLOSURE OF INVENTION

It is an object of the present invention to reduce environmental effects on the toner monitor reading $V_M$ by applying a temperature correction to all readings.

It is another object of the present invention to ensure that each toner monitor reading is statistically significant under all operating conditions.

According to a feature of the present invention, a toner monitor system, which measures the toner concentration of a development mixture of toner particles and carrier, includes a toner monitor having an output signal which is proportional to the toner concentration of a measured development mixture, means for applying a control voltage to the toner monitor whereby the toner monitor output signal for any given toner concentration is further determined by the applied control voltage, and means for setting the control voltage such that the toner monitor output voltage midpoint is constant regardless of environmental changes.

In a preferred embodiment of the present invention, the environmental changes are temperature shifts, the output voltage is centered at mid range for a nominal toner concentration, and the control voltage setting used to center the toner monitor output voltage at its midpoint is stored during a setup cycle.

According to another feature of the present invention, the toner monitor system further includes a reference member having a temperature stable magnetic permeability positioned to align with the toner monitor so as to simulate to the toner monitor a nominal toner concentration, wherein the means for setting the control voltage is adapted to center the toner monitor output voltage at its midpoint for the nominal toner concentration.

According to another feature of the present invention, the toner monitor system further includes means, operable in a stand-by mode after the setup cycle for adjusting the control voltage to return the toner monitor output voltage to its midpoint value when the toner monitor is aligned with the reference member, and means for adjusting the control voltage applied to the toner monitor during measurements of the toner concentration of a development unit by the difference between the control voltage determined during the setup cycle and the control voltage determined during the stand-by mode.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
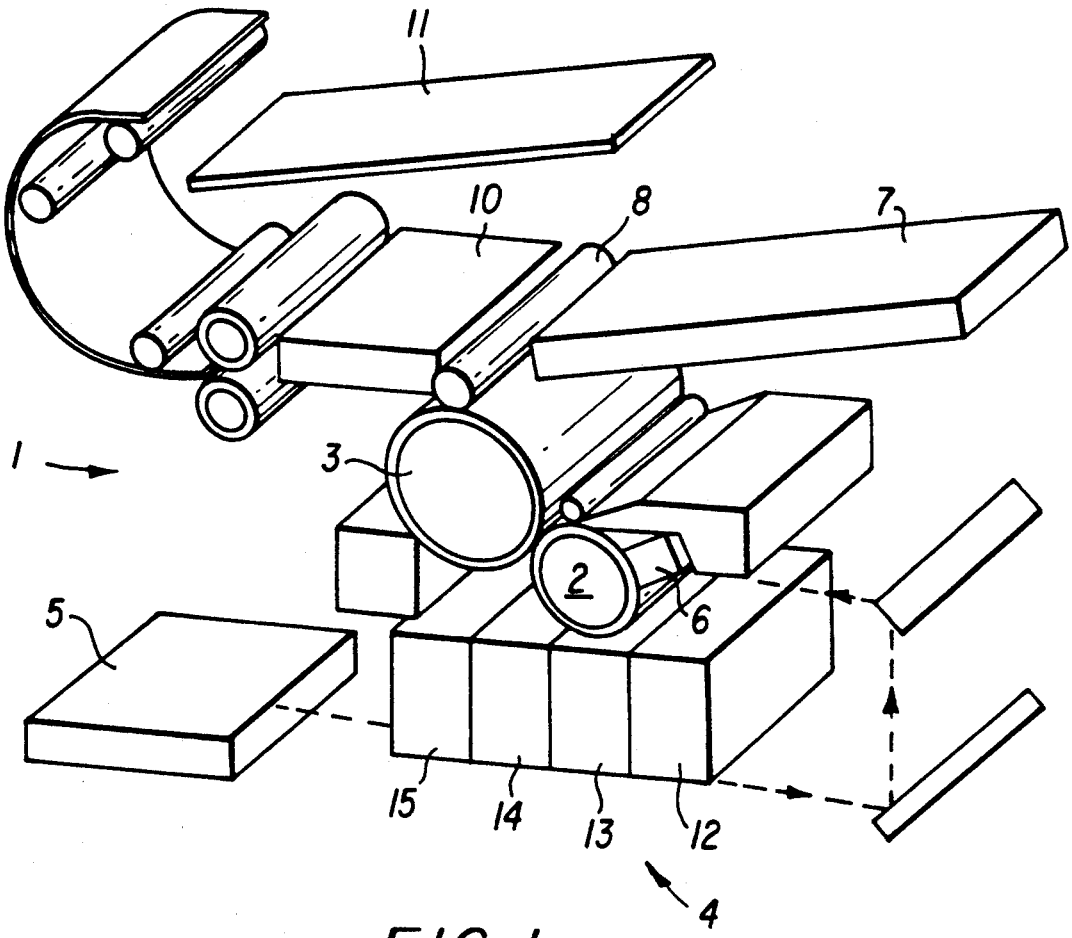
FIG. 1 is a front perspective view of an electrostatographic machine in which reference members according to the present invention are useful.

According to FIG. 1, an electrophotographic color printer 1 includes a photoconductive drum 2 mounted for rotation past a series of stations to create multicolor toner images on a transfer roller 3 or on a receiving sheet carried by transfer roller 3, according to a process well known in the art. More specifically, drum 2 is uniformly charged at a charging station 6, imagewise exposed at an exposure station, for example by a laser exposure station 5, to create a series of electrostatic images.

The electrostatic images are developed by a development device 4, which applies a different color toner to each of the series of images to form a series of different color toner images. The series of toner images are then transferred in registration to a surface associated with transfer roller 3 to create a multicolor toner image. The surface associated with roller 3 can either be the surface of transfer roller 3 or the outside surface of a receiving sheet secured to the surface of roller 3. If the multicolor image is formed directly on the surface of transfer roller 3, it is best utilized by being transferred to a receiving sheet from a supply 7 at a position 8 remote from drum 2. The transferred image is fused at 10, and the finished sheet is stacked at 11.

A series of four development units 12–15 are moved through a development position allowing each of the electrostatic images to be toned by a different development unit but using only a single developing position associated with drum 2.

According to FIG. 1, the development units are all fixed in a laterally movable carriage supported on guide rails, not shown, for linear movement in a horizontal direction below drum 2.

Figure 2:
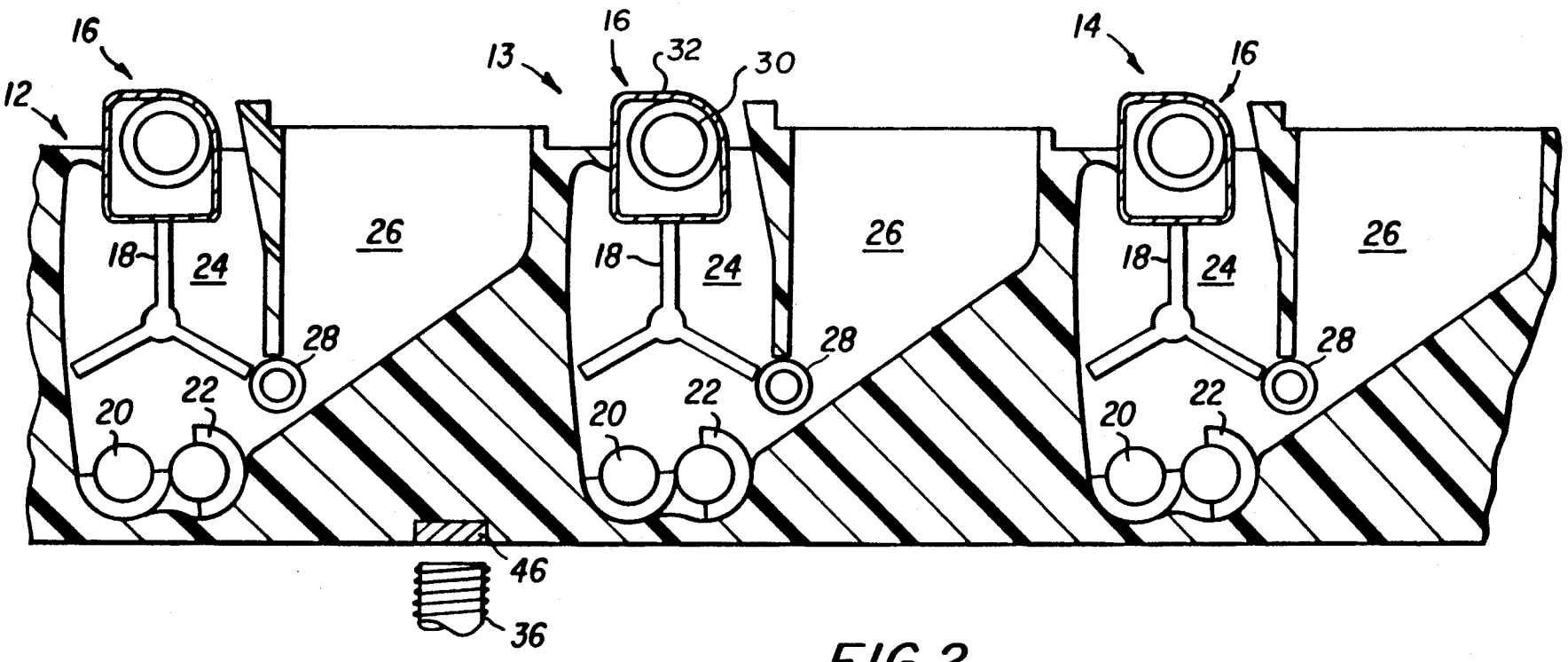
FIG. 2 is a rear cross-sectional view of a more detailed showing of a development device usable in the electrostatographic machine shown in FIG. 1.

Referring to FIG. 2, a development unit 13 includes an applicator 16 and a mixing device such as paddle 18 and augers 20, 22. The mixing device is located in a development chamber 24 which contains a mixture of hard magnetic carrier particles and insulating toner particles. A supply of toner particles is contained in a toner chamber 26. Toner particles are fed from toner chamber 26 to development chamber 24 by a toner feed roller 28.

In operation, rotation of paddle 18 and augers 20, 22 cause both the mixing of developer in chamber 24 and a raising of the level of that developer making it accessible to the magnetic field of applicator 16. Applicator 16 includes a rotatable magnetic core 30 and a stationary sleeve 32. Hard magnetic carrier particles move around the sleeve in response to rotation of the core bringing the developer through the developing position. The developer is moved by the rotating core at essentially the same speed as the electrostatic image is moving on rotating drum 2 providing high quality development of the electrostatic image.

A plurality of development units 12–15, which are of essentially the same construction, form development device 4 of FIG. 1. After development of a first electrostatic image, a motor, not shown, is actuated to drive development device 4 to the right, as illustrated, until applicator 16 of development unit 13 becomes aligned with the exposure position for toning a second electrostatic image. The process is repeated for development units 14 and 15. The motor is reversed after all four images have been toned, and toning device 4 is returned to the left to its original position.

A toner monitor 36 is provided in a fixed position below toning device 4 such that the development unit 12–15 which is at the developing position of drum 2 is aligned with the monitor. Toner monitor 36 may be chosen from several commercially available products, such as, for example, those responsive to changes in effective permeability of two component developers and manufactured by Hitachi Metals, Ltd. Toner monitor 36 emits an analog signal which is representative of the permeability in the development mixture, and thus representative of the toner concentration.

As set forth above, variables associated with the measurement of the toner concentration in development units 12–15 can interject error in the output of toner monitor 36. According to the present invention, means are provided for calibrating the toner monitor to compensate for such variables.

A reference member 46 having known permeability is positioned in development device 4 such that member 46 aligns with toner monitor 36 as the development device shifts between its positions aligning development units 12 and development units 13 with the developing position. FIG. 2 shows the development device in its position aligning member 46 with the toner monitor. Member 46 simulates a nominal toner concentration to the toner monitor. During start up, the output signal of the toner monitor when aligned with member 46 is stored in memory as a base value. From time-to-time during operation, the output signal of the toner monitor when aligned with member 46 is compared to the base value. Any difference between the output of the monitor and the base value is used to compensate future signals from the toner monitor accordingly.

Reference member 46 permits the detection of shifts of the output signal of the toner monitor caused by changing environment. The first reading for member 46 for each new development unit will be stored as a base value. The difference between the first reading and later readings will be added to or subtracted from the later reading of that station to compensate the output change of the sensor due to environment change.

In order to eliminate the temperature effects of the toner monitor, it is necessary for the reference member to have a stable, but not necessarily any particular (predefined) magnetic permeability. The permeability should, however, fall within the range of control voltages used to measure the permeability of the four development mixtures.

Figure 3:
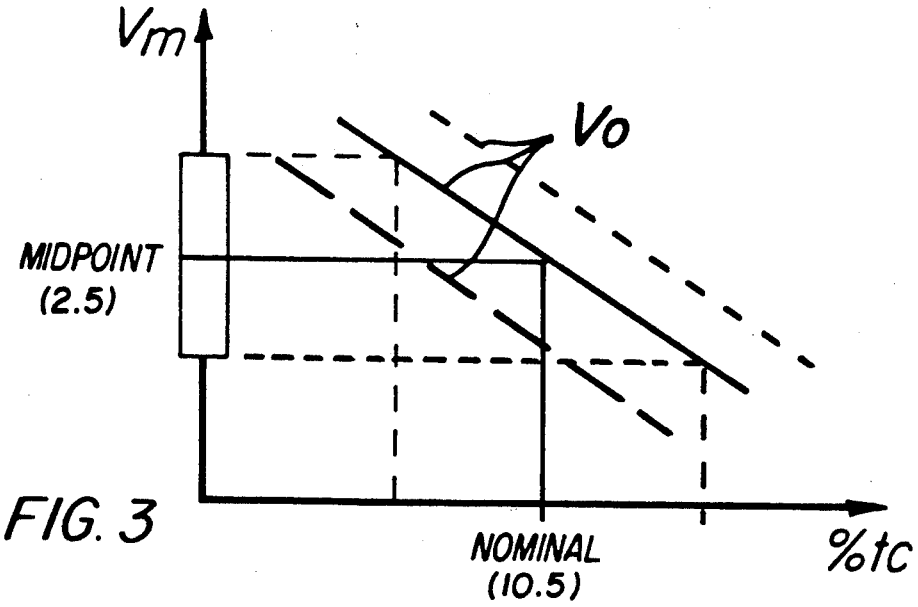
FIG. 3 is a graph showing monitor output voltage $V_M$ as a function of toner concentration tc and control voltage $V_C$.

Referring to FIG. 3, toner monitor output voltage $V_M$ is inversely proportional to the toner concentration in the development mixture. The proportionality factor (the slope of the lines in FIG. 3) is inherent to the toner monitor and its electronic circuit. For different control voltages supplied to the toner monitor, the toner output voltage is shifted, at a given toner concentration, over the full output voltage range as shown by the three lines in FIG. 3. Inversely, a fixed monitor output voltage can be achieved for various toner concentrations if the control voltage is adjusted appropriately. Therefore, by moving the operating curve of the monitor in a predefined way, the control voltage supplied externally enlarges the range of toner concentration which can be measured.

Often, it is found that the inherent sensitivity of monitors is insufficient, particularly for use with hard magnetic materials. In order to provide a statistically reliable toner monitor reading for all operating conditions, the mode of operation of the toner monitor has been modified according to the present invention such that the externally supplied control voltage is used to provide the true toner monitor reading already temperature compensated. The numerical calculation necessary to correct the toner monitor reading on each development device for temperature effects is used, according to this invention, to calculate a modified control voltage. By this, the operating characteristic of the toner monitor is always maintained such that, for nominal toner concentration (for example, 10.5% in FIG. 3), the toner monitor output voltage is centered at mid range (2.5V in FIG. 3); regardless of temperature effects such as drifts or hysteresis. Thus, the toner monitor is always operated in the center of its operating range. Operating characteristics for toner monitors are always defined the best for the center of their operating range. In this mode of monitor operation, monitor reading $V_M$ obtained from each development unit is representative of the true toner concentration without any corrections. Any difference in toner concentration from the nominal toner concentration (10.5% tc in FIG. 3) would result in a difference in monitor output voltage $V_M$ from mid range (2.5V in FIG. 3).

OPERATION

Referring to FIGS. 1 and 2, a development device 4 is loaded into the machine in the illustrated "home" position. Only in the "home" position does the reference member 46 integrated into the development device come into position to be measured by toner monitor 36.

The four color cartridge is also equipped with means, such as a fusible link (not shown), for differentiating between a brand new development device and an old device which was used before, but was temporarily removed by the customer. Upon loading a new development device, the state of the fusible link is determined and, if the device is determined to be brand new, a SETUP cycle is initiated. It is the purpose of the SETUP cycle to update LCU-memory with information characteristic to the new development device and the developer materials in it.

To this end, the development device is cycled through all four toning positions bringing each color into measurement position above the toner monitor. The station augers are activated for a specified amount of time and a toner monitor reading is taken. For each development unit 12–15, the control voltage $V_C$ is adjusted until the toner monitor output voltage $V_M$ equals the mid range reading ($V_M$=2.5V in the above example). Control voltage $V_C$ necessary to produce the mid range reading for $V_M$ is stored in LCU memory, one control voltage for each color as $V_{C-i-SETUP}$, with i=C,M,Y,K.

After cycling the development device through its four toning positions, the cartridge is returned to its "home" position, bringing the reference member into measurement position above the toner monitor. Again, control voltage $V_C$ is adjusted until the monitor output voltage $V_M$ for the reference member is at mid range. The control voltage for the reference member $V_{C-ref-SETUP}$ is stored into LCU-memory. Upon completion of the SETUP cycle, the fusible link in the development device is destroyed.

At the conclusion of the SETUP cycle, the control voltages associated for the four developers with the nominal toner concentration of a brand new development device (i.e., % $tc_{new}$=10.5%) are stored in the LCU-memory. Because the toner monitor output voltage was actively centered to mid range for every color, maximum use of the linear response range of the toner monitor is provided for each color. Furthermore, any offsets in the monitor voltage caused by varying development unit wall thicknesses, varying toner monitor wall thicknesses, or varying densifications between colors are compensated for.

The temperature of the toner monitor at the time of the SETUP cycle can be any temperature within the specified operating range. The monitor readings obtained during the SETUP cycle are still subject to the large temperature sensitivity of the monitor.

After completion of the SETUP cycle, the system goes into a STAND-BY mode. The development device is in "home" position and a toner monitor reading of the reference member can be taken for as often as the LCU allows. As the temperature (ambient or machine internal) changes over time, the monitor voltage ($V_{M-ref}$) changes due to the large temperature coefficient of the monitor itself. In order to maintain a constant monitor output voltage for the reference member ($V_{M-ref}$=2.5 V) despite the changing temperature, the control voltage has to be adjusted by the LCU. The difference in control voltage ($WV_{C-ref}$) for the reference member in the STAND-BY mode and control voltage determined at the time of the SETUP cycle is calculated and continuously updated into LCU memory.

At the time printing is requested and executed, the four colors will be moved into toning position above the toner monitor. For each color, the monitor voltage ($V_{M-i}$, with i=C,M,Y,K) is then measured by setting the control voltage to the control voltage used in the SETUP cycle corrected by the current control voltage difference for the reference member. With this procedure, the difference in monitor voltage $WV_{M-i}$ becomes directly proportional to the change in toner concentration of the development mixture (W % $tc_i$). Temperature effects are, thus, reduced to residual temperature gradients since the last "STAND-BY"-measurement, because temperature differences $WT=T^{STAND-BY}-T^{SETUP}$ are accounted for by way of the continuously updated control voltage for temperature stable reference member.

This requires that changes in $V_M$ are a linear function of $V_C$ for the entire range of $V_C$. For the full range of $V_C$, $V_M=f(V_C)$ is not linear. However, in experiments, only a small range of $V_C$ had to be used. For a reduced range of $V_C$ between 8.5V and 11.5V, $V_M=f(V_C)$ appears to be linear. In case a linear approximation of $V_M=f(V_C)$ is not possible, the non-linear function has to be determined and stored in the LCU memory.

The operation of the toner concentration control system according to this invention is not limited to the electrostatographic marking engines similar to the one used in the example. The invention applies to such systems in all those types of marking engines, where a single monitor is used to detect the toner concentration of more than one development mixture. The operating mode according to this invention makes use of the electronic adjustment of the toner monitor in order to compensate for changes in environmental conditions such as temperature. In the example, the change in temperature is sensed by using a temperature stable reference member which simulates the relative magnetic permeability of a development mixture.

The advantages of this invention over prior art are fourfold. First, the toner monitor is always operated at mid range of its operating characteristic regardless of operating conditions such as ambient temperature variations, material variations and/or variations in monitor/-developer mix spacings. Second, the toner monitor is controlled by means of the externally supplied control voltage so that the toner monitor reading $V_M$ taken from the development unit directly represents the true toner concentration, and any difference from the mid range output voltage is directly proportional to the change in toner concentration of the development mixture. Third, all manufacturing tolerances between individual printers, individual developer cartridges, and individual toner monitors used over the entire lifetime of the program are compensated for since the operating mode includes a SETUP cycle executed in each individual printer. Fourth, since the operating mode includes a SETUP cycle executed in each individual printer, the manufacturing tolerances of the reference member are of no consequence for the toner concentration control system's accurate performance; the reference member can provide the temperature stable reference reading as long as the permeability value simulated by the reference member is within the monitor output range, preferably at range midpoint, for any externally supplied control voltage.

In general, the operating mode of the electronically adjustable toner monitor allows a cost-effective design of a toner concentration control system using one toner monitor for more than one development unit. At the same time, the toner concentration control system operated according to this invention is robust, because the impact of manufacturing tolerances of various subsystem components is substantially reduced.

The invention has been described in detail with particular reference to preferred embodiments thereof, but it will be understood that variations and modifications can be effected within the spirit and scope of the invention.

What is claimed is:

1. A toner monitor system for measuring the toner concentration of a development mixture of toner particles and carrier, said system comprising:

a toner monitor having an output signal which is proportional to the toner concentration of a measured development mixture;

means for applying a control voltage to the toner monitor, whereby the toner monitor output for any given toner concentration is further determined by the applied control voltage;

means for setting the control voltage such that the toner monitor output voltage midpoint is substantially constant regardless of temperature changes; and a reference member having a temperature stable magnetic permeability positioned to align with said toner monitor so as to simulate to the toner monitor a nominal toner concentration, wherein said means for setting the control voltage is adapted to center the toner monitor output voltage at its midpoint for said nominal toner concentration.

2. A toner monitor system as defined in claim 1 further comprising memory means for storing the control voltage setting used to center the toner monitor output voltage at its midpoint during a setup cycle.

3. A toner monitor system as defined in claim 1 wherein said reference member has a predetermined magnetic permeability.

4. A toner monitor system as defined in claim 3 further comprising a memory means adapted to store the control voltage setting used to center the toner monitor output voltage at its midpoint for said nominal toner concentration during a setup cycle.

5. A toner monitor system as defined in claim 4 further comprising:

means, operable in a stand-by mode after the setup cycle for adjusting the control voltage to return the toner monitor output voltage to its midpoint value when the toner monitor is aligned with the reference member; and means for adjusting the control voltage applied to the toner monitor during measurements of the toner concentration of a development unit by the difference between the control voltage determined during the setup cycle and the control voltage determined during the stand-by mode.

6. A toner monitor system for measuring the toner concentration of a development mixture of toner particles and carrier in a development device having a plurality of development units, said system comprising:

a single toner monitor having an output signal for each development unit, said signal being proportional to the toner concentration of the respective development unit;

means for applying a control voltage to the toner monitor, whereby the toner monitor output signal for any given toner concentration is further determined by the applied control voltage;

means for setting the control voltage for each development unit such that the toner monitor output voltage midpoint is substantially constant regardless of development unit and temperature changes; and a reference member having a know magnetic permeability positioned to align with said toner monitor so as to simulate to the toner monitor a nominal toner concentration, wherein said means for setting the control voltage is adapted to center the toner monitor output voltage at its midpoint for said nominal toner concentration.

7. A toner monitor system as defined in claim 6 further comprising memory means for storing the control voltage setting used to center the toner monitor output voltage at its midpoint during a setup cycle.

8. A toner monitor system as defined in claim 6 wherein said reference member has a predetermined magnetic permeability.

9. A toner monitor system as defined in claim 8 further comprising a memory means adapted to store the control voltage setting used to center the toner monitor output voltage at its midpoint for said nominal toner concentration during a setup cycle.

10. A toner monitor system as defined in claim 9 further comprising:

means, operable in a stand-by mode after the setup cycle for adjusting the control voltage to return the toner monitor output voltage to its midpoint value when the toner monitor is aligned with the reference member; and means for adjusting the control voltage applied to the toner monitor during measurements of the toner concentration of one of said development units by the difference between the control voltage determined during the setup cycle and the control voltage determined during the stand-by mode.

* * * * *